United States Patent [19]

Tanaka

[11] 4,271,834

[45] Jun. 9, 1981

[54] DISPOSABLE PORTABLE MASK FOR EMERGENCY USE

[76] Inventor: Yoshio Tanaka, 2-7-6, Shibuya, Shibuya-ku, Tokyo, Japan, 150

[21] Appl. No.: 56,039

[22] Filed: Jul. 9, 1979

[30] Foreign Application Priority Data

Sep. 11, 1978 [JP] Japan ..... 53-123721

[51] Int. Cl.[3] ..... A62B 7/10

[52] U.S. Cl. ..... 128/205.27; 128/203.29; 128/206.19; 128/207.11; 128/202.13

[58] Field of Search ..... 128/203.29, 204.13, 128/205.29, 206.12, 206.14, 206.19, 202.13, 206.21, 206.28, 269, 290 W, 296, 151, 260, 261, 263, 270, 205.27; 132/88.5, 88.7; 15/104.93; 206/361, 205, 210

[56] References Cited

U.S. PATENT DOCUMENTS

| | | | |
|---|---|---|---|
| Re. 24,549 | 10/1958 | Haliczer | 128/206.19 |
| 1,101,756 | 6/1914 | Nesvadba | 128/206.19 |
| 3,374,882 | 3/1968 | Amaliksen | 206/361 |
| 3,419,136 | 12/1968 | Pratt | 206/361 |

*Primary Examiner*—Henry J. Recla

*Attorney, Agent, or Firm*—Victor R. Beckman

[57] ABSTRACT

A disposable portable mask for emergency use in a contaminated atmosphere is disclosed, which mask comprises a sponge of adequate size to cover a user's mouth and nostrils. The sponge is impregnated with water or an aqueous solution of an acidic salt, or weak alkali salt, for adsorption of toxic acidic gases passed therethrough. Perfume may be included in the sponge to mask any disagreeable odors of the sponge or liquid materials employed. The liquid-containing sponge is compressed and sealed within a fluid-tight container of plastic, or the like, to prevent evaporation of the liquid from the sponge. The overall package is of small size for ease in carrying in a person's pocket, handbag, or the like, so as to have a mask available for ready use at all times with a minimum of inconvenience. For use in case of an emergency, the mask is removed from the container and placed over the person's mouth and nostrils for adsorbing toxic gases breathed therethrough, preventing inhalation thereof. Securing means for attaching the mask to the user's face may be provided to free the hands of the user for other uses. The entire mask simply is disposed of after use.

6 Claims, 3 Drawing Figures

FIG-1
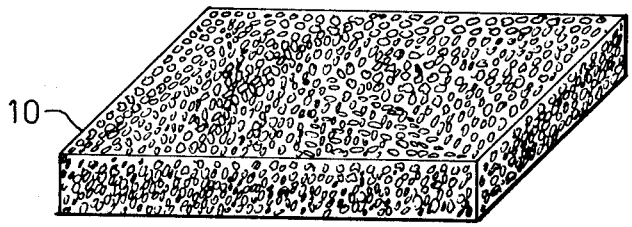
FIG-3
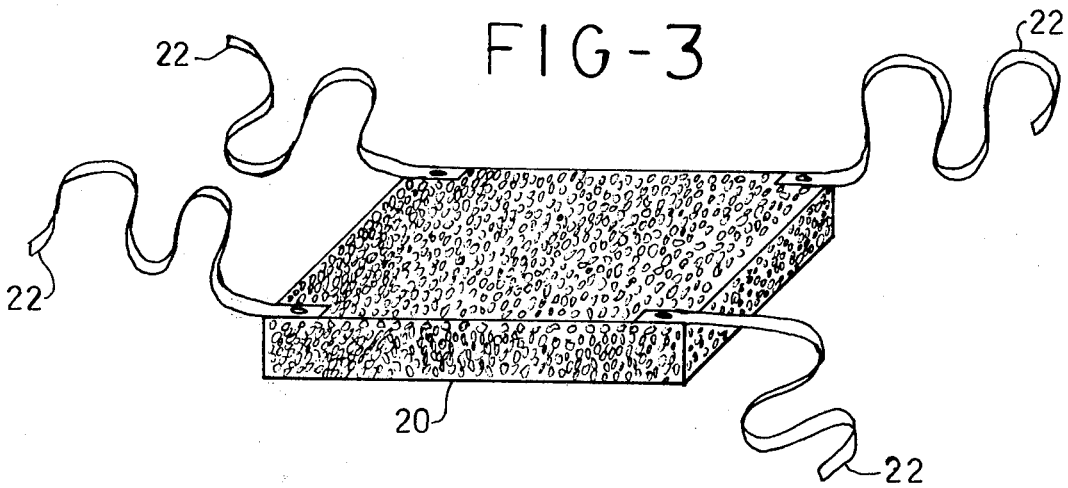
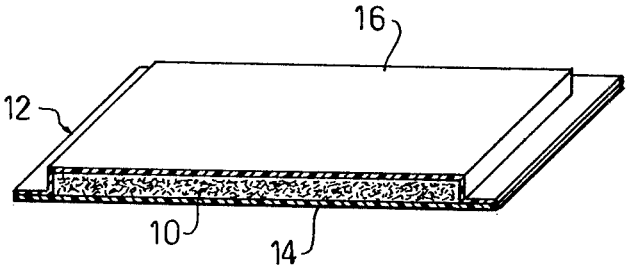
FIG-2

DISPOSABLE PORTABLE MASK FOR EMERGENCY USE

BACKGROUND OF THE INVENTION

This invention relates to a disposable portable mask for use by individuals in emergency situations where toxic gas which is harmful to breathe is present in the atmosphere. Toxic gases may escape from continers, or be generated, as in the case of fires. The generation of toxic gas during fires is becoming an increasingly serious problem, particularly as more use of plastic material is made in the construction and furnishing of buildings, vehicles, and the like. Presently, there are restrictions on the use of such toxic gas generating materials. Also, the use of fire retardants with plastic material is required in some cases. Nevertheless the hazards involved by inhalation of such gases are great and have not been eliminated by existing regulations and restrictions. Deaths due to poisoning by toxic gases generated during fires are particularly prevalent in cases of multistory building fires where escape is difficult and/or requires additional time as compared, for example, to escape from single-story structures. In any emergency evacuation situation involving the presence of toxic gases, it will be apparent that the use of a mask to limit inhalation of such gases is desirable. Evacuees sometimes are advised to place a wet towel or handkerchief over their face to inhibit breathing of the toxic gases. Often, however, this is not practical, as in situations where water is not readily available. Commercial gas masks could be used, but generally they are not available. Additionally, they are expensive, difficult to use, bulky, and not easily carried at all times by a person.

SUMMARY OF THE INVENTION AND OBJECTS

An object of this invention is the provision of a mask for use in emergency situations where toxic gases are present in the atmosphere, which mask is of such small size and weight as to be easily carried in a person's pocket, handbag, or the like.

An object of this invention is the provision of a disposable portable mask of the above type which is inexpensive and very effective in reducing toxic gas poisoning.

The above and other objects and advantages of the invention are achieved by use of a mask comprising a sponge of adequate size and shape to cover a person's mouth and nostrils. The sponge is soaked with water, or an aqueous solution capable of adsorbing toxic, acidic, gases. The liquid-impregnated sponge is packed in a fluid-tight container or bag for storage thereof without evaporation and loss of the liquid. It may be packed in a compressed state to further reduce the size of the package, making it additionally easier to carry. Sterile liquid is used to avoid contamination, and perfume may be included to mask any undesired odor of the sponge or liquid materials used. Also, securing means for securing the sponge to the user's face may be included. Alternatively, an elongated strip of cloth, or the like, may be included in the package for use in attaching the sponge to the user's face.

The invention, as well as other objects and advantages thereof, will become apparent from the following detailed description thereof when considered with the accompanying drawings.

BRIEF DESCRIPTION OF THE DRAWINGS

In the drawings, wherein like reference characters refer to the same parts in the several views:

FIG. 1 is a perspective view of a sponge of the type which is suitable for use with the present invention;

FIG. 2 is a fragmentary perspective view showing the sponge compressed and packaged in a fluid-tight container; and FIG. 3 is a view which is similar to that of FIG. 1 but showing also securing means for attaching the sponge to the user's face.

Reference first is made to FIG. 1 wherein there is shown a sponge 10 which may be used in the present invention. A natural sponge may be used. Preferably, however, the sponge comprises resilient foamed rubber, either of the synthetic or natural type, or resilient foamed plastic, such as foamed polyurethane, foamed polyvinyl chloride, or the like.

The sponge is soaked, or impregnated, with a liquid such as water, or an aqueous solution capable of adsorbing toxic gases. An aqueous solution of an acid salt, or a weak alkaline salt solution, capable of adsorbing acidic toxic gases, may be used. Suitable salts include, but are not limited to, sodium bicarbonate, sodium acetate, sodium phosphate, sodium hydrogen phosphate, and the like. A sterile solution is used to avoid contamination of the sponge. The solution may be boiled or made sterile by the addition of a suitable chemical agent. Also, perfume may be included to mask any disagreeable odor of either the sponge material or the chemical solution. In any event, the sponge is soaked with an aqueous solution capable of adsorbing acidic toxic gases.

The soaked, or impregnated, sponge 10 is contained in a fluid-tight package, or container, 12, shown in FIG. 2 of the drawings, to prevent evaporation and other such loss of the fluid so long as the sponge is sealed therewithin. The illustrated container is shown comprising base and cover members 14 and 16, respectively, sealed together about the periphery thereof as by the use of an adhesive, heat sealing, or the like.

In the illustrated arrangement the solution-impregnated sponge is compressed when packaging the same to further reduce the size of the package to be carried.

A sponge of any suitable size and shape for covering the user's mouth and nostrils may be used. For example only, and not by way of limitation, sponge dimensions on the order of, say, 10 to 20 cm length, 10 to 20 cm width, and 1 to 3 cm thickness may be employed for maximum convenience in carrying and using the same. Also, the sponge may be packaged in a folded, or rolled, condition, rather than the illustrated unfolded condition, particularly where a larger size sponge is employed.

In use, the package 12 is opened and the liquid-impregnated sponge is removed therefrom. Since it is packaged in a compressed condition, the sponge expands upon removal from the package, thereby greatly increasing the gas adsorptive capacity thereof. The sponge then is placed over the mouth and nostrils of the user for adsorption of acidic toxic gases present in the atmosphere, to substantially prevent the toxic gases from entering the user's lungs during breathing.

Means for securing the sponge filter to the user's face may be included. In FIG. 3, to which reference now is made, a liquid-impregnated sponge 20 is shown, which may be made of the same sponge material as sponge 10 and impregnated with the same liquid described above. The liquid-impregnated sponge 20 is provided with securing means for attachment thereof to the user's face which, in the illustrated arrangement, comprise thin straps, or strings, 22 attached to the four corners of the sponge. The strings are adapted for use in tying the mask over the user's mouth and nostrils. Obviously, other means for attaching the sponge to the user's face may be included. For example, adhesive may be provided along one or more edges of the sponge for direct attachment to the user's face. Also, elastic cords may be attached to the sponge which encircle the user's head for holding the mask in place. Alternatively, an elongated strip of cloth may be packaged with the sponge for use in tying the sponge in place.

The invention having been described in detail in accordance with the requirements of the U.S. Patent Statutes, various other changes and modifications will suggest themselves to those skilled in this art, which changes and modifications are intended to fall within the spirit and scope of the invention recited in the appended claims.

I claim:

1. An improved disposable portable mask for use in the presence of toxic gases in emergency situations comprising, facemask means comprising a blank piece of sponge means of size and shape for covering a user's mouth and nostrils, an aqueous solution capable of adsorbing acidic toxic gases impregnating the sponge means for adsorption of toxic gases breathed therethrough by the user, and a fluid-tight container for storage of the aqueous solution-impregnated sponge means to maintain the same in moist condition.

2. A disposable portable mask as defined in claim 1 wherein said aqueous solution consists of an acid salt or a weak alkaline salt for adsorption of acidic toxic gas.

3. A disposable portable mask as defined in claim 2 wherein said aqueous solution is selected from the group consisting of sodium bicarbonate, sodium acetate, sodium phosphate and, sodium hydrogen phosphate.

4. A disposable portable mask as defined in claim 1 wherein said sponge comprises foam consisting of rubber or plastic.

5. A disposable portable mask as defined in claim 1 wherein said liquid-impregnated sponge is in a compressed condition within said container and expands to a full natural size upon removal from said container.

6. A disposable portable mask as defined in claim 1 including securing means in said container for attaching the sponge over the user's mouth and nostrils.

* * * * *